US006233793B1

(12) United States Patent
Wanzenböck

(10) Patent No.: US 6,233,793 B1
(45) Date of Patent: May 22, 2001

(54) TWO-STEP GARMENT CLOSURE, EPECIALLY AS A FRONT CLOSURE FOR A BRASSIERS

(75) Inventor: Karl Wanzenböck, Leobersdorf (AT)

(73) Assignee: Fildan Accessories Corporation, Englewood, NJ (US)

( * ) Notice: Subject to any disclaimer, the term of this patent is extended or adjusted under 35 U.S.C. 154(b) by 0 days.

(21) Appl. No.: 09/376,839

(22) Filed: Aug. 18, 1999

(51) Int. Cl.[7] ..... A44B 11/00
(52) U.S. Cl. ..... 24/615; 24/614; 450/58
(58) Field of Search ..... 24/614, 615, 616, 24/662, 68 E, 326, 182, 585; 2/73, 322, 333; 450/28, 58, 71, 86

(56) References Cited

U.S. PATENT DOCUMENTS 1,205,247 * 11/1916 Munroe ..... 24/614
2,495,667 * 1/1950 Vizner ..... 24/662 X
3,200,464 * 8/1965 Cousins ..... 24/616 X
5,427,562 * 6/1995 Hwang ..... 450/58
5,784,765 * 7/1998 Fildan ..... 24/615
5,957,748 * 9/1999 Ichiha ..... 450/58

* cited by examiner

*Primary Examiner*—Robert J. Sandy
(74) *Attorney, Agent, or Firm*—Herbert Dubno

(57) ABSTRACT

A two-step garment closure, especially for front closing brassieres, has a spherically shaped front portion which is depressible to allow the closure to extend from its contracted position into an extended position. When a button-shaped formation on the rear of the slider is actuated from the back of the closure, the slide can separate from the body of the closure. Alternatively the actuator can be pivoted so that the entire operation can be effected from the front. The closure can thus extend from its contracted into an extended position when the actuator is pivotally swung in one sense and the slide can be fully withdrawn from the body when the actuator is depressed in the opposite sense by the wearer also from the front.

27 Claims, 8 Drawing Sheets

FIG. 1
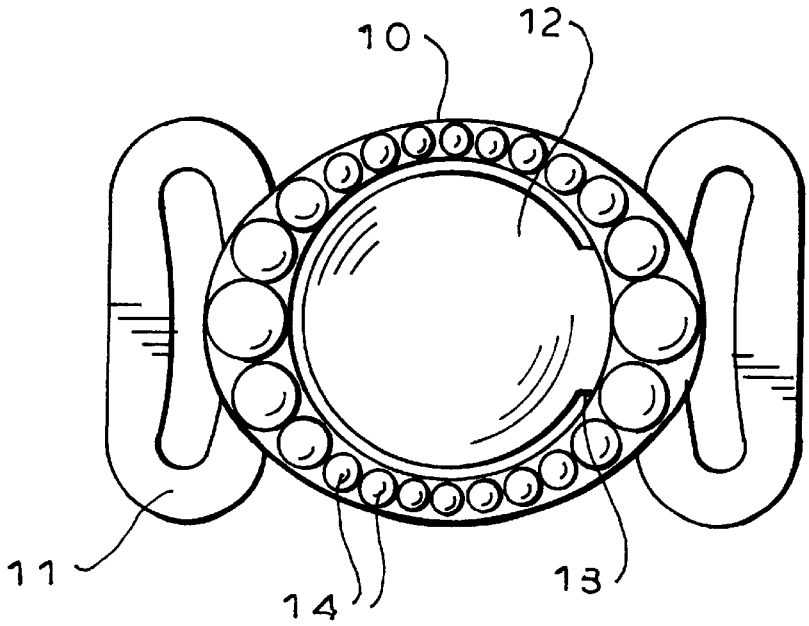
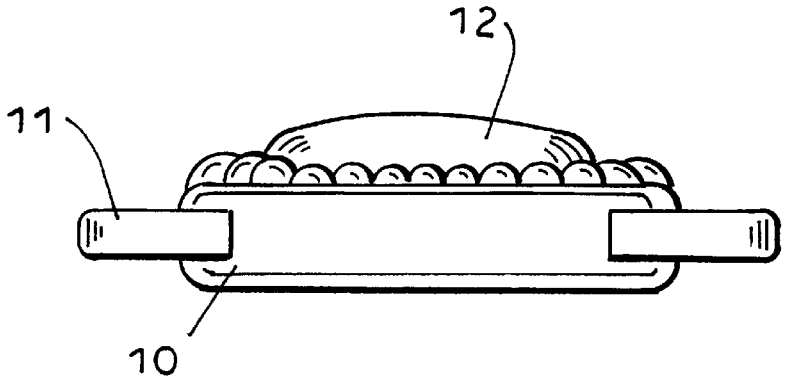
FIG. 2

FIG. 3
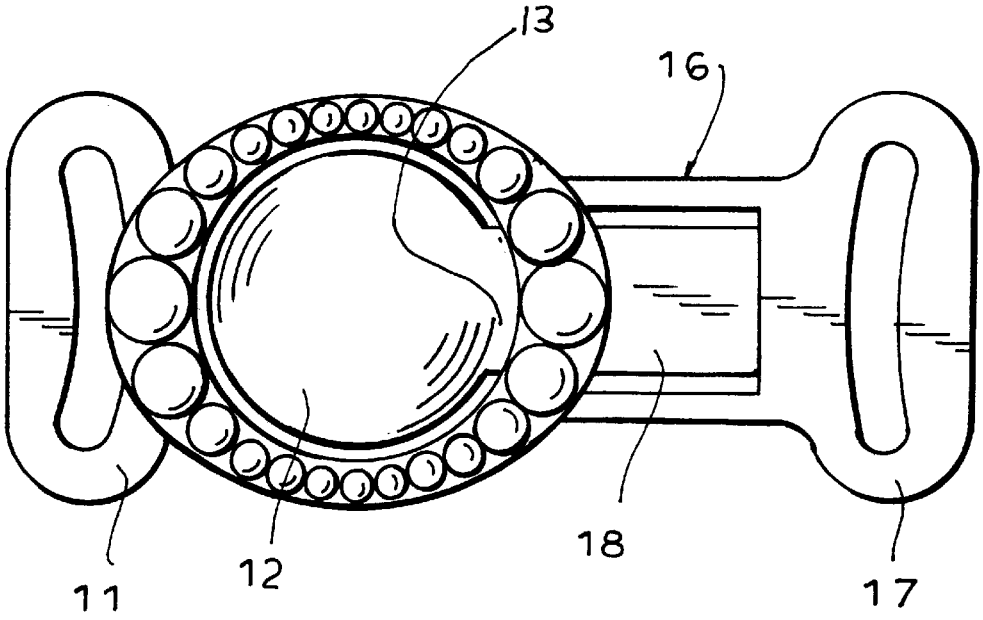
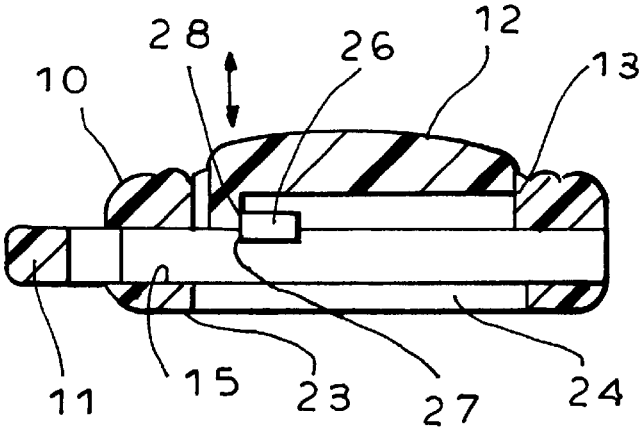
FIG. 4

FIG. 8
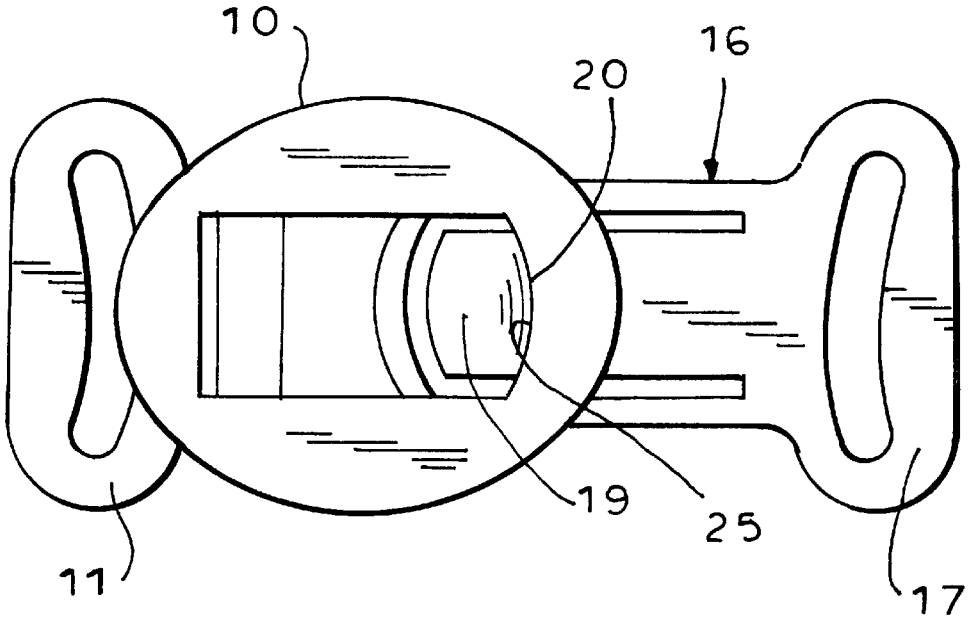
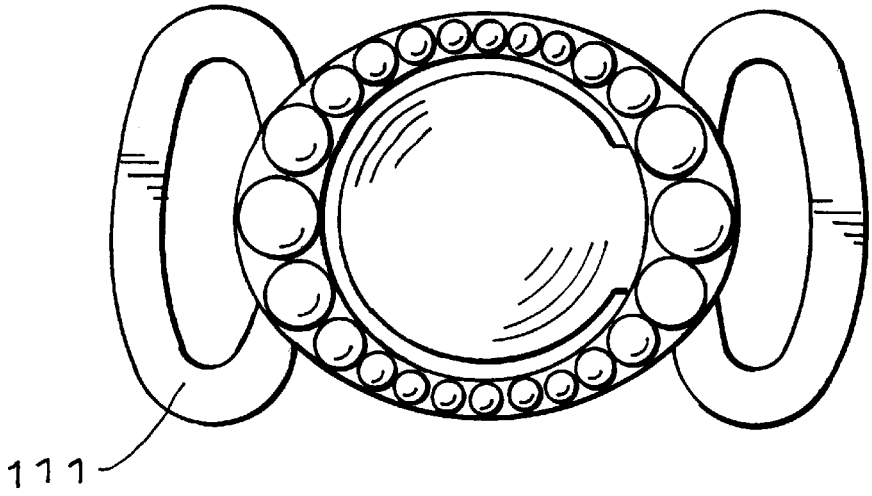
FIG. 9

FIG. 10
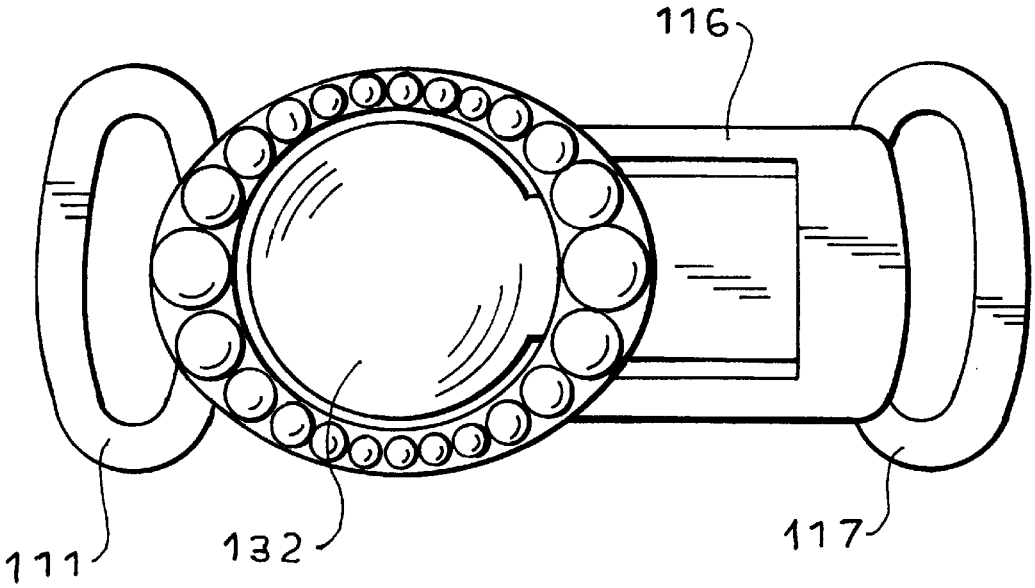
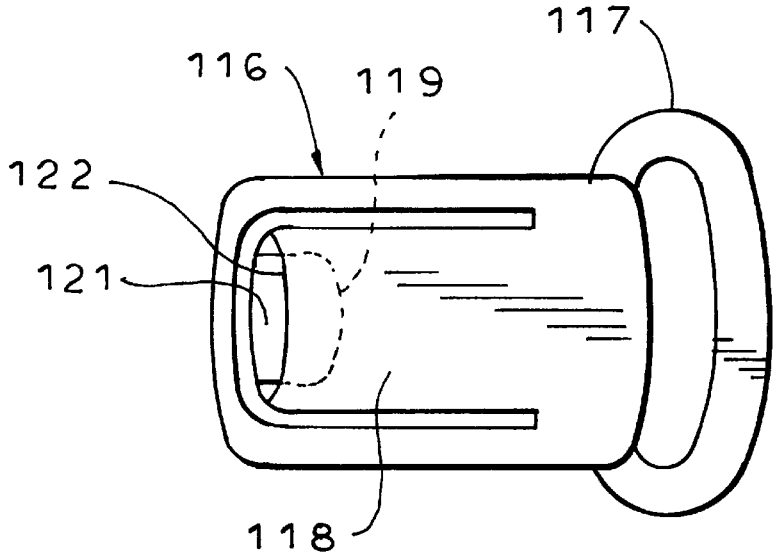
FIG. 12

FIG. 11
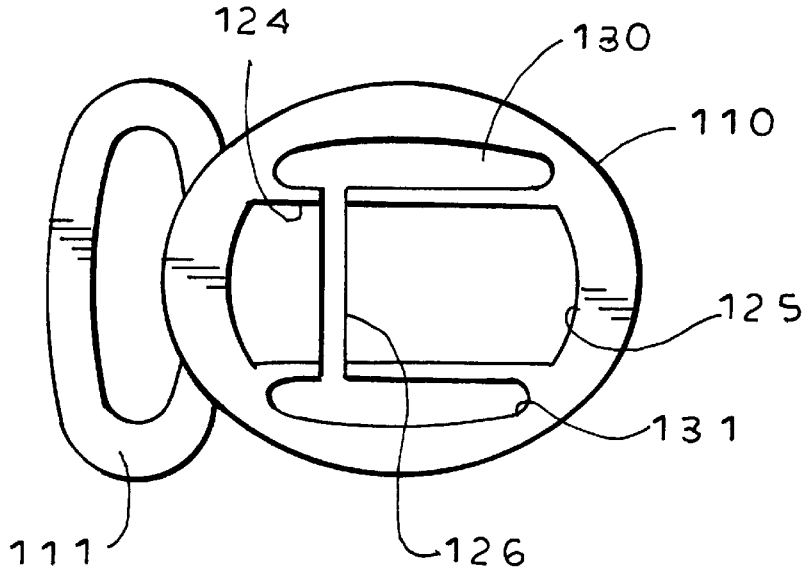
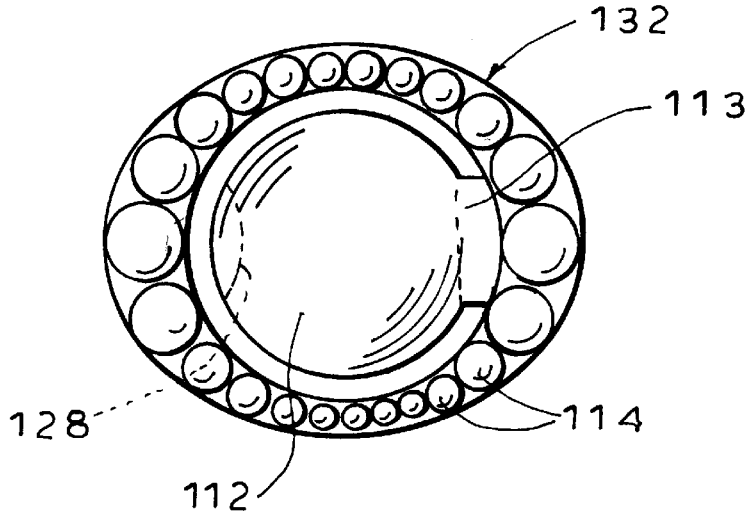
FIG. 13

FIG. 14
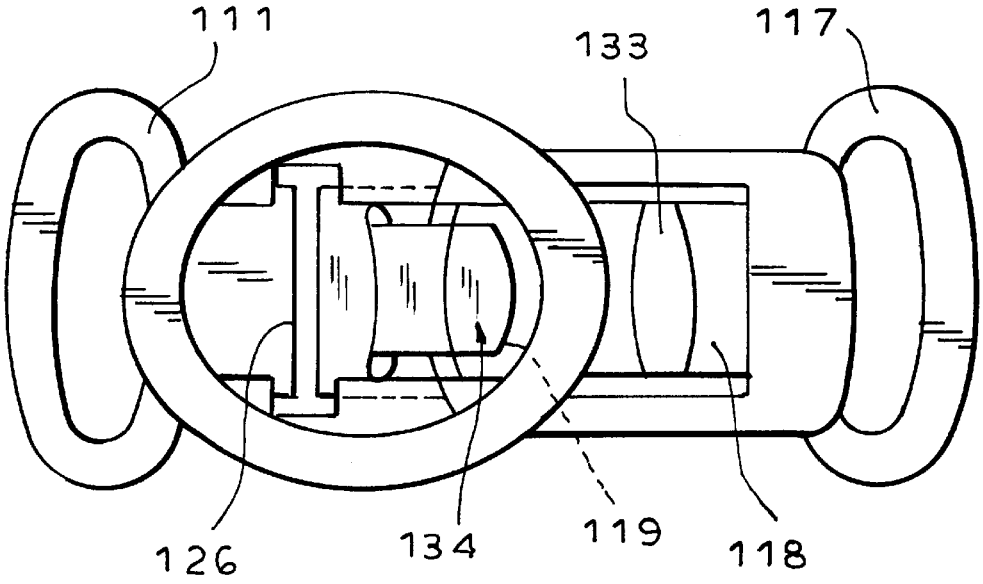
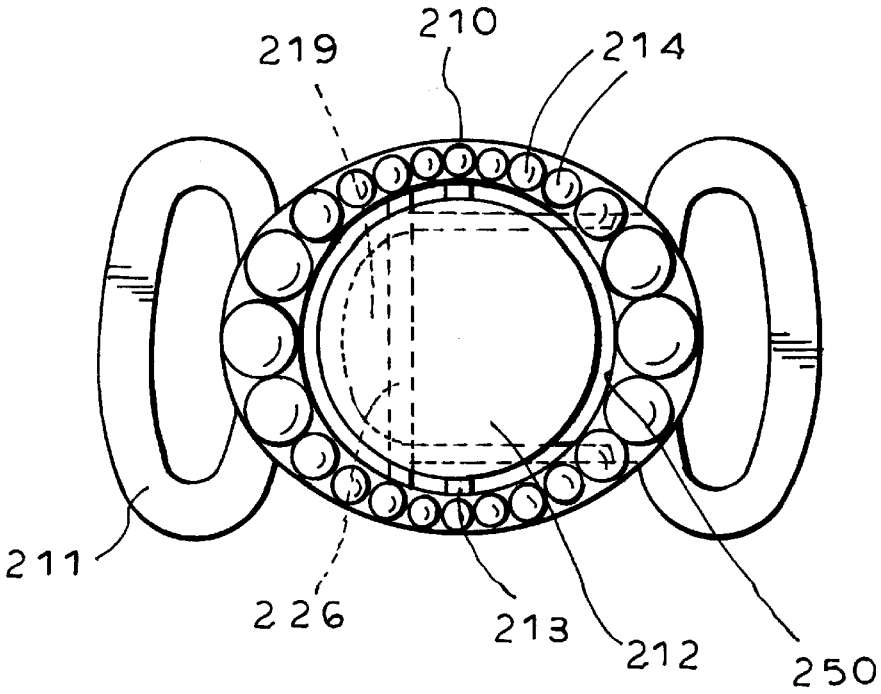
FIG. 15

FIG. 16
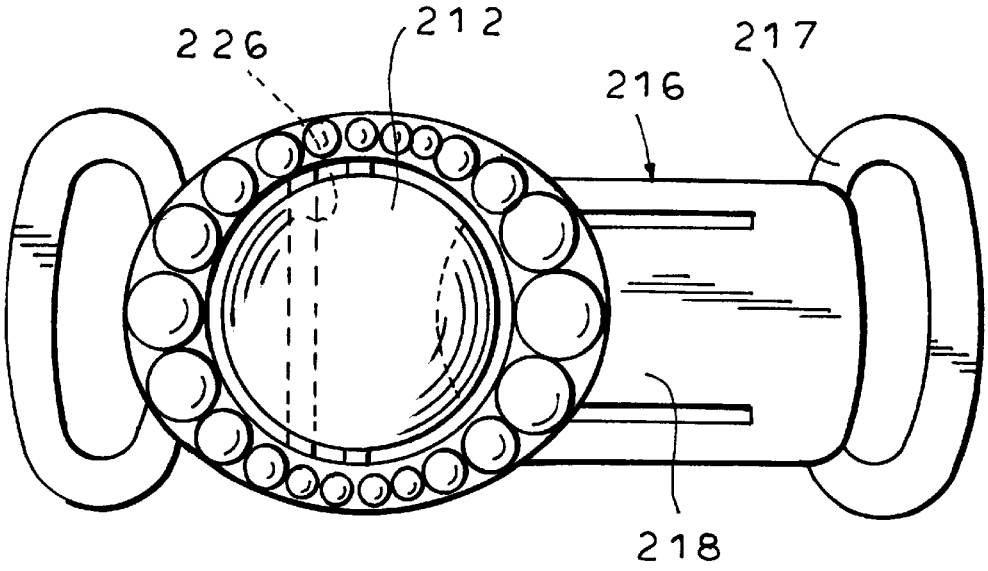
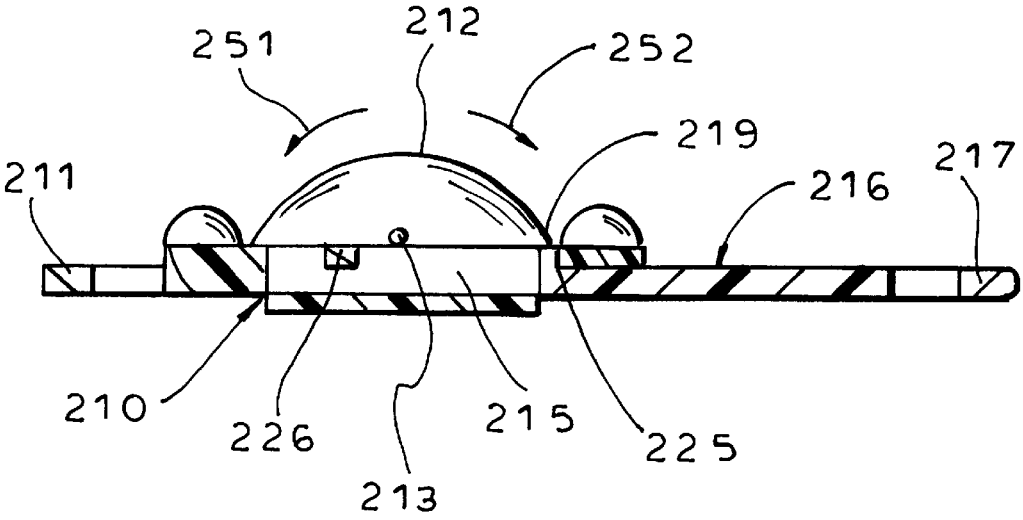
FIG. 17

TWO-STEP GARMENT CLOSURE, EPECIALLY AS A FRONT CLOSURE FOR A BRASSIERS

FIELD OF THE INVENTION

The present invention relates to a two-step garment closure and, more particularly, to a garment closure which is adjustable from a contracted position to an extended position and which is particularly suitable for use as a front closure for a front-opening brassiere.

BACKGROUND OF THE INVENTION

Front opening brassieres have been provided heretofore with front closures having two parts slidably fitted together, one part being affixed to one side of the brassiere while the other part is fixed to the other side of the brassiere and can be interfitted with the first part to hold the two sides of the garment together. When a button portion is depressed, the two parts of the closure can separate, thereby allowing the brassiere to open.

There are closures which also allow adjustment in use (see U.S. Pat. No. 5,784,765), which, upon depression of a portion of the closure will allow the closure to extend into a second closed position without full separation of the parts. For example, when the wearer is riding in an automobile and desires to relax the brassiere, the closure can be actuated directly through the blouse of the wearer to allow the closure to extend from its fully contracted position to an extended but unseparated state. Also without removing the blouse, the wearer can press the sides of the closure together to restore the contracted position. A two-step closure of this type has the advantage that it allows adjustment while the garment is being worn from a tighter position to a more relaxed fit without full separation but yet permits full separation when the closure is, like a front closure for a brassiere, used to allow opening and closing of the garment.

While the aforementioned closure has been found to be highly effective, it is somewhat longer than is desirable for many brassiere designs and thus is subject to improvement.

OBJECTS OF THE INVENTION

It is the principal object of the present invention to provide an improved two-step closure which can be more compact than the closures hitherto used and yet retain the advantages of the earlier closures.

Another object of the invention is to provide a two-step closure which is more aesthetically pleasing, especially for use as a front closure for a brassiere, then front closures known heretofore.

Still another object of this invention is to provide an improved two-step closure which also affords ease of complete separation, is inexpensive to manufacture and use, and is free from drawbacks of prior art closures.

SUMMARY OF THE INVENTION

These objects and others which will become apparent hereinafter are attained, in accordance with the invention in a step garment closure in which one side of the body of the closure into which a slide can be fitted, is formed with a depressible portion which can release the slide to allow it to disengage from its contracted state and move into an extended position while an opening on the opposite side of the body exposes a depressible portion of the slide which, in this extended position, can be actuated for full release of the parts of the closure.

Thus the button in the front of the closure, where the garment is a front-closing brassiere, can be operated to allow the closure to assume a relaxed state while actuation of the closure from the rear thereof can release the closure entirely. As a consequence, the closure can be far more compact and shorter than the earlier closures mentioned.

More particularly, the two-step garment closure can comprise:

- a closure body provided with means for securing the body to one part of a garment having two separable parts, the body having a depressible portion on one side thereof and an opening on an opposite side thereof; and
- a slide receivable in the body and provided with means for securing the slide to another part of the garment, the slide having a deflectable tongue, the body forming two spaced-apart stops for the slide respectively retaining the slide in a fully inserted position in the body corresponding to a contracted state of the closure and a partially withdrawn position corresponding to an expanded state of the closure, the depressible portion being actuatable from the one side to release the slide from the fully inserted position and permit the slide to move into the partially withdrawn position, the tongue being formed with a button actuatable through the opening from the other side to release the slide from the body and permit full withdrawal of the slide from the body and separation of the parts.

The means for securing the body to one part of the garment and the slide to the other part of the garment can be strap eyes where the garment parts are straps or are affixed to the closure by straps, or they can be tabs which can be stitched into the garment as in the case of the front closure of U.S. Pat. No. 5,784,765 or one of the attachment elements can be such a stitch-through tab while the other is a strap eye.

It has been found to be advantageous to provide the body with a decorative pattern around the depressible member, e.g. in the form of spherical formations simulating pearls. The body can have an oval outline while the depression member can be outwardly convex, i.e. spherically convex, with a circular outline.

According to a feature of the invention, the tongue is formed on opposite sides thereof with shoulders engaging the respective stops.

One of the stops can be an edge of the opening or window at the back of the body while the other stop is a bar extending transversely to the direction of insertion and removal of the slide.

In another feature of the invention, the decorative pattern which will be visible and the depressible member can be formed as a cap which is pressed onto the body of the garment closure and can be injection molded or otherwise shaped from a plastic material which can be of the same color as the body and the slide or can be of a different color, e.g. one which is selected to have an aesthetic relationship to the garment. The slide and the body may be a colorless plastic while the cap may be pink, white or of another color matching the brassiere with which the fastener is used. To facilitate the second stage of the opening process, i.e. full release of the slide from the body, the back of the body may be provided with a deflectable member which acts upon the slide to release the detent.

Alternatively, the deflectable portion of the slide may be provided with a formation which is exposed when the slide is partially pulled out, to enable the wearer to readily engage the deflectable portion and release the second stop.

In that case, the button is separate from the detent of the slide.

Alternatively, the adjustment in opening can be effected only from the front side. In that case, the oval push piece can be pivoted so that it can be displaced by being pressed in at either side of the pivot. When pressed in at the left side, for example, the garment closure can be permitted to expand and when pressed in on the right side, can be released or opened. A reverse operation is also possible.

BRIEF DESCRIPTION OF THE DRAWING

The above and other objects, features, and advantages will become more readily apparent from the following description, reference being made to the accompanying drawing in which:

FIG. 1 is a front elevational view of the two-step garment closure of the invention in its contracted state;

FIG. 2 is a side elevational view thereof;

FIG. 3 is a view similar to FIG. 1 showing the closure in its extended state;

FIG. 4 is a longitudinal section through the body of the closure;

FIG. 8 is a rear view of the extended closure; and FIG. 9 is a view similar to FIG. 1 but showing a two-step garment closure in its retracted step, but with the strap engaging eyes of a different configuration from that of FIG. 1;

FIG. 10 is a view similar to FIG. 3 of the embodiment of FIG. 9;

FIG. 11 is a front view of the body of the fastener of FIGS. 9 and 10 with the cap removed and the slide fully withdrawn;

FIG. 12 is a front view of the slide which has been fully withdrawn from the body of FIG. 11;

FIG. 13 is a front view of the cap separated from the body;

FIG. 14 is a view similar to FIG. 8 for the embodiment of FIGS. 9–13;

FIG. 15 is a view similar to FIG. 1 showing an alternative construction of the two-step garment closure in its contracted state wherein both operations can be effected from the front;

FIG. 16 is a view similar to FIG. 3 for this latter closure in its extended state; and FIG. 17 is a longitudinal section through the closure in its extended state.

SPECIFIC DESCRIPTION

Figure 6:
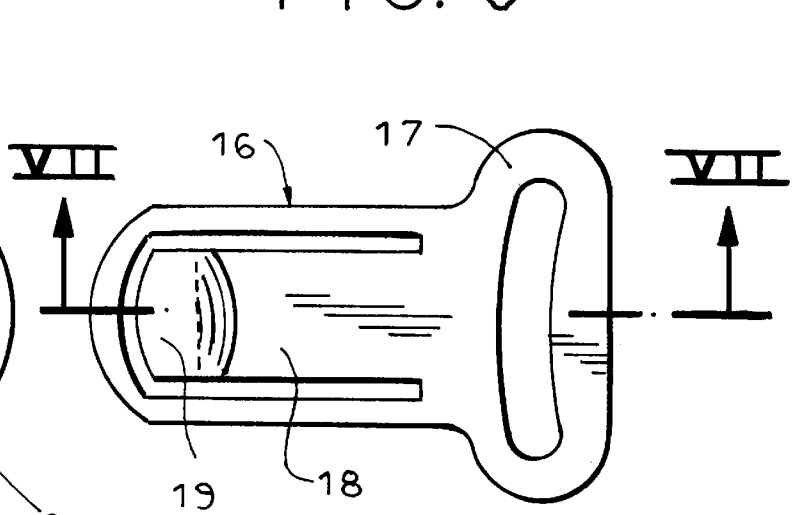
FIG. 6 is a rear view of the slide receivable in that body.

As can be seen from FIG. 1, the body 10 of the closure is formed unitarily with an eye 11 adapted to receive a strip of one part of a garment which is separable or openable. The closure may be used, in particular, for a front closing brassiere between the two cups thereof. Instead of an eye 11, a tab or flange which is sufficiently thin to be stitched through upon manufacture of the brassiere can be used (see U.S. Pat. No. 5,784,765).

The body 10 has an oval configuration and is formed with a depressible portion 12 which is spherically convex and is attached by a film hinge 13 to the balance of the body. Around the depressible portion 12, with its circular outline, is a decorative pattern on the body constituted as generally spherical formations 14 simulating a row of pearls of graduated diameter varying from the largest diameter along the major axis of the oval to smallest diameter along the minor axis of the oval.

Figure 7:
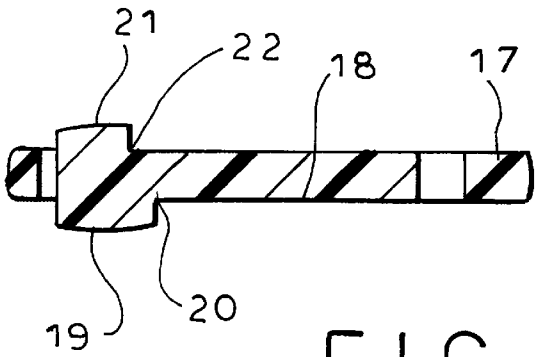
FIG. 7 is a cross sectional view taken along the line VII—VII of FIG. 6.

The body 10 is formed with a channel 15 along the longitudinal axis receiving a slide 16 (see FIGS. 3 and 6) which, in turn, is formed with a strip eye 17 (or a stitching flange or tab as has previously been described). The slide has a tongue 18 and can be fitted into the channel. On one side of the tongue 18 is a button-shaped protuberance 19 (see also FIG. 7) having a shoulder 20. A formation 21 on the opposite side of the tongue 18 has a shoulder 22.

Figure 5:
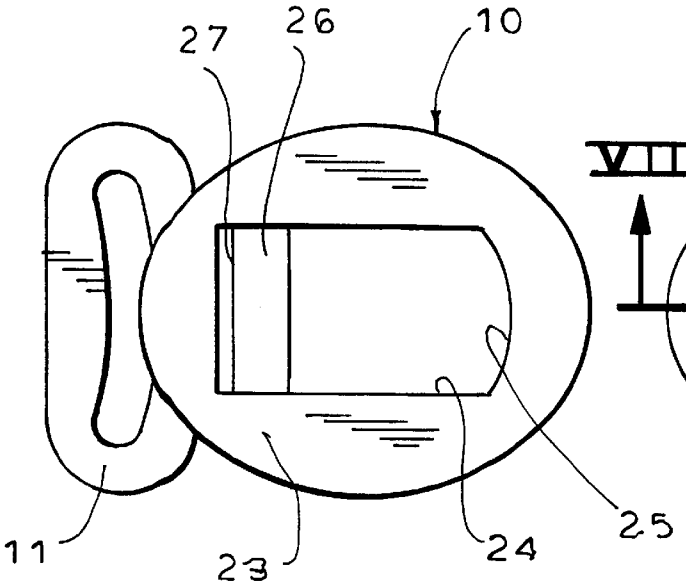
FIG. 5 is a rear view of the body of the closure showing the window or opening in the back thereof.

As can be seen from FIGS. 4, 5 and 8, on the back or rear side 23 of the body 10, there is formed a window or opening 24 which has an edge 25 forming a stop engageable by the shoulder 20 (see FIG. 8).

Across the channel 15 on the other side thereof, the body 10 is provided with a bar 26 forming a stop edge 27 for the shoulder 22 of the tongue 18.

Consequently, upon full insertion of the slide 16 into the channel 15, the shoulder 22 engages behind the edge 27 of the bar 26 to retain the closure in the contracted position shown in FIG. 1.

When the depressible portion 12 is pushed inwardly, e.g. through the blouse of the wearer, the finger 28 of the depressible portion 12 can press the formation 21 downwardly to release the shoulder 22 from the bar 26 and allow the slider 16 to pull partway out of the body 10 into the position shown in FIG. 3 in which the shoulder 20 engages the edge 25. The garment is thus relaxed.

Finally, when it is intended to open the closure entirely and permit separation of the slider from the body 10, the formation 19 is pressed inwardly from the back of the closure to release the shoulder 20 from the stop edge 25 and thereby permit the slider to be fully withdrawn.

With the embodiment of FIGS. 9–14, the body 110 can be seen to be formed unitarily with an eye 111 which is adapted to receive a strap of one part of a garment which is separable or openable, e.g. a strap of a front closing brassiere between the two cups thereof. The eye 111 is shaped to have downwardly convex edges and thus to conform more closely to the contour of the body than does the eye 11 of the body 10 of the closure shown in FIGS. 1–8.

In the embodiment of FIGS. 9–14 as well, the body 110 may have an oval configuration and can have a bar of overhanging ledges 130, and 131 which form a track for the slider 116 and which are interconnected by the bar 126. The ledges 130 and 131 engage in a cap 132 (FIG. 13) which is formed with the depressible portion 112 of a spherically convex configuration or an oval configuration. The depressible portion 112 is connected by a film hinge 113 to the balance of the cap 132. Around the depressible portion 112 which has an oval outline in this embodiment, is a decorative pattern constituted as generally spherical configurations 114 simulating a row of pearls as has been described for the embodiment of FIGS. 1–8.

The overhanging ledges 130, 131 form a channel or guide along the longitudinal axis receiving the slide 116 which is formed with another eye 117 of a shape similar to that of the eye 111, or with a stitching flange or tongue as has previously been described. The slide has a tongue 118 and can be fitted into the channel. On one side of the tongue 118 is a button-shaped protuberance 119. The other side of the tongue has a formation 121 which is provided with a shoulder 122, the latter being defined, if desired, by a depression in the tongue 118 into which a projection on the bar 126 (not shown) can engage.

From FIG. 11 it will be apparent that the body 110 is formed with a window or opening 124 which has an edge 125 forming a stop for the button 119. The bar 126 forms a stop for the shoulder 122. Upon full insertion of the slide 116 into the body 110, the shoulder 122 engages behind the edge of the bar 126 to retain the closure in the contracted position shown in FIG. 9. When the depressible portion 112 is pushed inwardly, e.g. through the blouse of the wearer, the finger 128 of the depressible portion 112 can press the formation 121 downwardly to release the shoulder 122 from the bar 126 and allow the shoulder 116 to pull part way out of the body into the position shown in FIG. 10 in which a shoulder 120 of the button 119 will engage the edge 125. The garment is thus relaxed and, when the user desires, the original position can be restored by simply pressing the slider back into the body until the shoulder 122 engages behind the bar 126.

When it is desired to permit separation of the slider 116 from the body 110, the tongue 118 must be pressed from the back to release the button 119 from the edge 125. This can be accomplished by pressing inwardly on a formation 133 on the tongue 118 which is exposed externally of the body in the partially withdrawn position of the slide, or by depressing a tongue 134 covering part of the back of the fastener and enabling inward pressing of the button 119 from the back. The button 119 is thus released from the edge 125 and the slider can be pulled out the remaining way and fully separated from the body 110. The wearer can thus remove the garment.

Another embodiment of the front closure is shown in FIGS. 15–17 in which the body 210 is formed with an eye 211 which is molded unitarily thereon together with the decorative forms 214 representing pearls. Within the oval opening 215, the body 210 is provided with an oval actuator 212 which can pivot about a fulcrum 213 when depressed on the left side and right side in opposite senses about the pivot 213.

The slide 216 which is received in a channel 215 of the body has an eye 217 (or a stitching flange or tab, as has been described) connected to the tongue 218 of the slide. A button-shaped protuberance 219 can engage a bar 226 in the closed position of the fastener (FIG. 15) or an edge 225 in the extended position of the fastener.

When the actuator 212 is operated so that it is swung in the counterclockwise sense (arrow 251), the formation 219 can be released from the bar 226 to permit the fastener to extend from its contracted position (FIG. 15) into its extended position (FIG. 16) to relax the garment. If the actuator 212 is then depressed from the front on the other side of the pivot 213 (arrow 252) so as to be swung in the clockwise sense, the formation 219 can be released from the edge 225 to allow full separation of the slider 216 from the body 210.

I claim:

1. A two-step garment closure comprising:

a closure body provided with means for securing said body to one part of a garment having two separable parts, said body having a depressible portion on one side thereof and an opening on an opposite side thereof; and a slide receivable in said body and provided with means for securing said slide to another part of the garment, said slide having a deflectable tongue, said body forming two spaced-apart stops for said slide respectively retaining said slide in a fully inserted position in said body corresponding to a contracted state of the closure and a partially withdrawn position corresponding to an expanded state of the closure, said depressible portion being actuatable from said one side to release said slide from said fully inserted position and permit said slide to move into said partially withdrawn position, said tongue being formed with a button actuatable from said other side to release said slide from said body and permit full withdrawal of said slide from said body and separation of said parts.

2. The garment closure defined in claim 1 wherein at least one of said securing means is an eye for receiving a strap.

3. The garment closure defined in claim 1 wherein each said securing means is an eye for receiving a respective strap.

4. The garment closure defined in claim 1 formed as a front closure for a brassiere wherein said body is provided on said one side with a decorative pattern around said depressible portion.

5. The garment closure defined in claim 4 wherein said decorative pattern is a row of spherical formations simulating pearls.

6. The garment closure defined in claim 1 wherein said tongue is formed on opposite sides thereof with shoulders engaging the respective stops.

7. The garment closure defined in claim 6 wherein one of said stops is an edge of said opening.

8. The garment closure defined in claim 7 wherein the other of said stops is a bar extending transversely to a direction of insertion of said slide into said body.

9. The garment closure defined in claim 1 wherein said body has an oval outline and said depressible portion is a member which is convex outwardly and has a circular outline.

10. The garment closure defined in claim 9 wherein said body is formed with a channel receiving said slide and extending along a major axis of the body.

11. The garment closure defined in claim 10 wherein said depressible portion is formed in one piece with said body and said tongue is formed in one piece with said slide.

12. The garment closure defined in claim 11 wherein at least one of said securing means is an eye for receiving a strap.

13. The garment closure defined in claim 12 wherein each of said securing means is an eye for receiving a respective strap.

14. The garment closure defined in claim 13 formed as a front closure for a brassiere wherein said body is provided on said one side with a decorative pattern around said depressible portion.

15. The garment closure defined in claim 14 wherein said decorative pattern is a row of spherical formations simulating pearls.

16. The garment closure defined in claim 15 wherein said tongue is formed on opposite sides thereof with shoulders engaging the respective stops.

17. The garment closure defined in claim 16 wherein one of said stops is an edge of said opening.

18. The garment closure defined in claim 17 wherein the other of said stops is a bar extending transversely to a direction of insertion of said slide into said body.

19. The garment closure defined in claim 1 wherein said depressible portion is formed integrally with a cap fitted on said body, said closure having a decorative pattern around said depressible portion.

20. The garment closure defined in claim 19, further comprising a deflectable tongue on a back of said body engageable by a wearer for engagement with said tongue to release said slide from said body.

21. The garment closure defined in claim 1 wherein said button is actuatable through said opening from said other side to release said slide from said body.

22. The garment closure defined in claim 19 wherein said button is provided on said tongue and is disposed externally of said opening for release of said slide from said body to permit full withdrawal thereof.

23. A two-step garment closure comprising:

a closure body provided with means for securing said body to one part of a garment having two separable parts, said body having an oval swingable portion on a front side thereof connected pivotally to said body at a location between opposite ends of the swingable portion; and a slide receivable in said body and provided with means for securing said slide to another part of the garment, said slide having a deflectable tongue, said body forming two spaced-apart stops for said slide respectively retaining said slide in a fully inserted position in said body corresponding to a contracted state of the closure and a partially withdrawn position corresponding to an expanded state of the closure, said portion being swingable in one direction to release said slide from said fully inserted position to permit said slide to move into said partially withdrawn position and in an opposite direction to release said slide from said body and permit full withdrawal of said slide from said body and separation of said parts.

24. The two-step garment closure defined in claim 23 wherein said tongue is formed with a button and one of said stops is a bar extending across a path of said slide upon insertion of said slide into said body, the other of said stops including an edge formed on said body, said portion being engageable with said button.

25. The two-step garment closure defined in claim 24 wherein said portion is oval.

26. The two-step garment closure defined in claim 25 wherein said means for securing said body to one part of a garment and for securing said slide to another part of said garment are respective eyes.

27. The two-step garment closure defined in claim 26 wherein said body is formed on said front side with a decorative pattern around said portion.

* * * * *